United States Patent [19]

Chiesa et al.

[11] 4,306,529

[45] Dec. 22, 1981

[54] ADAPTIVE AIR/FUEL RATIO CONTROLLER FOR INTERNAL COMBUSTION ENGINE

[75] Inventors: Alan F. Chiesa, Yale; Fayetta L. Colden, Lake Orion; David A. Singer, Farmington; John A. Zahorchak, Warren, all of Mich.

[73] Assignee: General Motors Corporation, Detroit, Mich.

[21] Appl. No.: 142,332

[22] Filed: Apr. 21, 1980

[51] Int. Cl.[3] ..... F02M 7/00

[52] U.S. Cl. ..... 123/440; 123/486; 123/489; 123/491

[58] Field of Search ..... 123/440, 480, 486, 489, 123/491; 60/276, 285; 364/431

[56] References Cited

U.S. PATENT DOCUMENTS

| | | | |
|---|---|---|---|
| 4,107,717 | 8/1978 | Klötzner et al. | 123/486 |
| 4,109,615 | 8/1978 | Asano | 123/440 |
| 4,130,095 | 12/1978 | Bowler et al. | 123/440 |
| 4,143,623 | 3/1979 | Norimatsu et al. | 123/440 |
| 4,166,437 | 9/1979 | Bianchi et al. | 123/486 |
| 4,187,812 | 2/1980 | Hosaka et al. | 123/440 |
| 4,200,064 | 4/1980 | Engele | 123/440 |
| 4,201,161 | 5/1980 | Sasayama et al. | 123/480 |
| 4,235,204 | 11/1980 | Rice | 123/480 |

*Primary Examiner*—Charles J. Myhre
*Assistant Examiner*—Andrew M. Dolinar
*Attorney, Agent, or Firm*—Howard N. Conkey

[57] ABSTRACT

An air/fuel ratio controller for an internal combustion engine including a memory having numbers stored at locations addressed by engine operating points with the locations addressed by the engine operating points being updated during closed loop operation in accord with the value of a closed loop adjustment of the air/fuel ratio. Each memory location in the memory is updated during operation of the engine at the corresponding operating point in accord with an update time constant having a value so that the number stored tracks adjustment value producing the predetermined desired closed loop air/fuel ratio during varying values of engine temperature. The update time constant is varied directly with the value of engine temperature so that the rate of adjustment of the numbers in the memory is greater during engine warmup where engine temperature increases rapidly. The memory is used during closed loop operation to preset the closed loop adjustment at least when the engine first operates at an operating point.

3 Claims, 12 Drawing Figures

ADAPTIVE AIR/FUEL RATIO CONTROLLER FOR INTERNAL COMBUSTION ENGINE

This invention relates to air/fuel ratio controllers for internal combustion engines.

Generally, air and fuel mixture delivery systems for vehicle engines including a carburetor are calibrated to provide a specified air/fuel ratio such as the stoichiometric ratio. However, for various reasons including manufacturing tolerances, it is difficult to provide for a fuel delivery system that maintains a constant air/fuel ratio over the entire operating range of the engine. Additionally, the air/fuel ratio of the mixture typically varies as the values of engine operating parameters including engine temperature vary. To maintain the air/fuel mixture supplied to the engine within a narrow band near the stoichiometric value to permit three way catalytic treatment of the exhaust gases discharged from the engine, closed loop controllers are generally employed. The most common forms of these closed loop systems respond to a sensor that monitors the oxidizing/reducing conditions in the exhaust gases and provide a control signal comprised of integral or integral pulse proportional terms for adjusting the air/fuel ratio of the mixture supplied to the engine. This signal may function to adjust the injection pulse width in a fuel injection system or to adjust a fuel regulating element of a carburetor to obtain the desired air/fuel ratio.

Due to the variations in the air/fuel ratio as the engine operation varies within its operating range, the time delays of the system including the engine transport delay (the time required for a particular air and fuel mixture to travel from the supply means, through the engine and to the exhaust gas sensor) and the time response of the closed loop controller, a time period is required in order for the controller to adjust for a change in the air/fuel ratio of the mixture supplied by the delivery means when the engine operation shifts from one operating point to another. During this time period, the ratio of the mixture supplied to the engine is offset from the desired ratio at which the desired three-way catalytic treatment of the exhaust gases exist resulting in an increase in the emissions in at least one undesirable exhaust gas constituent.

In order to compensate for the variation in the mixture supply characteristics over the engine operating range, it has been proposed to provide a memory having a number of locations addressed by the engine operating point defined by parameters such as speed and load. Each memory location has a value stored therein representing the adjustment amount determined to produce the desired air/fuel ratio at that particular engine operating point. When the operating point shifts from one point to another, the closed loop controller output is preset or initialized to the value stored in the corresponding memory location so that the controller is thereby initialized to a value determined to produce the predetermined air/fuel ratio thereby eliminating the above-mentioned time period required to adjust the air/fuel ratio. The memory location is thereafter updated in accord with the controller output during closed loop operation at that engine operating condition so that the memory location contains a number determined during engine operation to produce the predetermined air/fuel ratio.

During closed loop operation, it is desirable to update the values in the memory such that the numbers stored therein are representative of the adjustment required to produce the predetermined air/fuel ratio at the existing values of the engine operating parameters affecting the air/fuel ratio such as engine temperature even though the operating parameter values are changing so that when the engine operating point changes, the closed loop adjustment is initialized to the value producing the desired air/fuel ratio. Typically, the values in the memory are updated in accord with a single time constant. However, a time constant that is appropriate for one engine temperature may not be appropriate for another engine temperature. For example, a time constant that provides a slow rate of adjustment of the values in memory and thereby provides desired filtering characteristics may be appropriate where operating parameters affecting the air/fuel; ratio such as temperature do not vary rapidly but may not be appropriate where those parameters vary rapidly, such as during the period of engine warmup. Where these parameters very rapidly, a time constant producing a faster rate of adjustment of the values in memory is more desirable. In accord with this invention, a memory providing adaptive control during closed loop operation is updated in accord with a time constant varying directly with temperature so that the adjustment values stored therein are updated substantially to the values producing the desired ratio even during the engine warmup period where engine temperature varies most rapidly.

In accord with the foregoing, it is the general object of this invention to provide for an improved adaptive air/fuel ratio controller for an internal combustion engine.

It is another object of this invention to provide for an air/fuel ratio controller for an internal combustion engine having a memory associated with closed loop control operation which is updated in accord with a time constant varying directly with temperature.

The invention may be best understood by reference to the following description of a preferred embodiment and the drawings in which.

Figure 1:
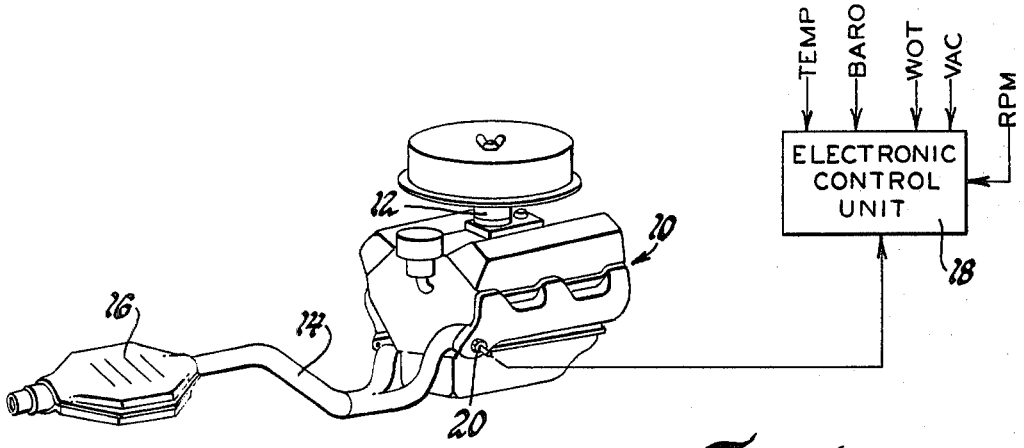
FIG. 1 illustrates an internal combustion engine incorporating an adaptive control system for controlling the air/fuel ratio of the mixture supplied to the engine in accord with the principles of this invention.

Referring to FIG. 1, an internal combustion engine 10 is supplied with a controlled mixture of fuel and air by a carburetor 12. However, in another embodiment, the fuel delivery means may take the form of fuel injectors for injecting fuel into the engine 10. The combustion byproducts from the engine 10 are exhausted to the atmosphere through an exhaust conduit 14 which includes a three-way catalytic converter 16 which simultaneously converts carbon monoxide, hydrocarbons and nitrogen oxides if the air-fuel mixture supplied thereto is maintained near the stoichiometric value.

The carburetor 12 is generally incapable of having the desired response to the fuel determining input parameters over the full range of engine operating conditions. Additionally, the carburetor 12 supplies varying air/fuel ratios with varying engine operating parameters such as temperature. Consequently, the air/fuel ratio provided by the carburetor 12 in response to the fuel determining input parameters typically deviates from the desired value during engine operation.

The air/fuel ratio of the mixture supplied by the carburetor 12 is selectively controlled open loop or closed loop by means of an electronic control unit 18. The carburetor 12 is adjusted in response to the output of an air-fuel sensor 20 positioned at the discharge point of one of the exhaust manifolds of the engine 10 to sense the exhaust discharged therefrom and in response to the outputs from various sensors including an engine speed sensor providing a speed signal RPM, an engine temperature sensor providing a temperature signal TEMP, a manifold vacuum sensor providing a vacuum signal VAC, a barometric pressure sensor providing a barometric pressure signal BARO, and a wide open throttle sensor providing a signal WOT when the carburetor throttle is moved to a wise open position. These sensors are not illustrated and take the form of any of the well known sensors for providing signals representative of the value of the aforementioned parameters.

During open loop control, the electronic control unit 18 is responsive to predetermined engine operating parameters to generate an open loop control signal to adjust the air/fuel ratio of the fuel supplied by the carburetor 12 in accord with a predetermined schedule. When the conditions exist for closed loop operation, the electronic control unit 18 is responsive to the output of the air/fuel sensor 20 to generate a closed loop control signal including integral and proportional terms for controlling the carburetor 12 to obtain a predetermined ratio such as the stoichiometric ratio. The carburetor 12 includes an air/fuel ratio adjustment device that is responsive to the open loop and closed loop control signal outputs of the electronic control unit 18 to adjust the air/fuel ratio of the mixture supplied by the carburetor 12.

In the present embodiment, the control signal output of the electronic control unit 18 takes the form of a pulse width modulated signal at a constant frequency thereby forming a duty cycle modulated control signal. The pulse width and therefore the duty cycle of the output signal of electronic control unit 18 is controlled with an open loop schedule during open loop operation when the conditions do not exist for closed loop operation and in response to the output of sensor 20 during closed loop operation. The duty cycle modulated signal output of the electronic control unit 18 is coupled to the carburetor 12 to effect the adjustment of the air/fuel ratio supplied by the fuel metering circuits therein. In this embodiment, a low duty cycle output of the electronic control unit 18 provides for an enrichment of the mixture supplied by the carburetor 12 while a high duty cycle value is effective to lean the mixture.

An example of a carburetor 12 with a controller responsive to a duty cycle signal for adjusting the mixture supplied by both the idle and main fuel metering circuits is illustrated in the U.S. patent application Ser. No. 051,978, filed June 25, 1979, which is assigned to the assignee of this invention and to which reference may be made for specific details. In this form of carburetor, the duty cycle modulated control signal is applied to a solenoid which simultaneously adjusts metering elements in the idle and main fuel metering circuits to provide for the air/fuel ratio adjustment.

In general, the duty cycle of the output signal of the electronic control unit 18 may vary between 5% and 95% with an increasing duty cycle effecting a decreasing fuel flow to increase the air/fuel ratio and a decreasing duty cycle effecting an increase in fuel flow to decrease the air/fuel ratio. The range of duty cycle from 5% to 95% may represent a change in four air/fuel ratios at the carburetor 12 of FIG. 1.

Figure 2:
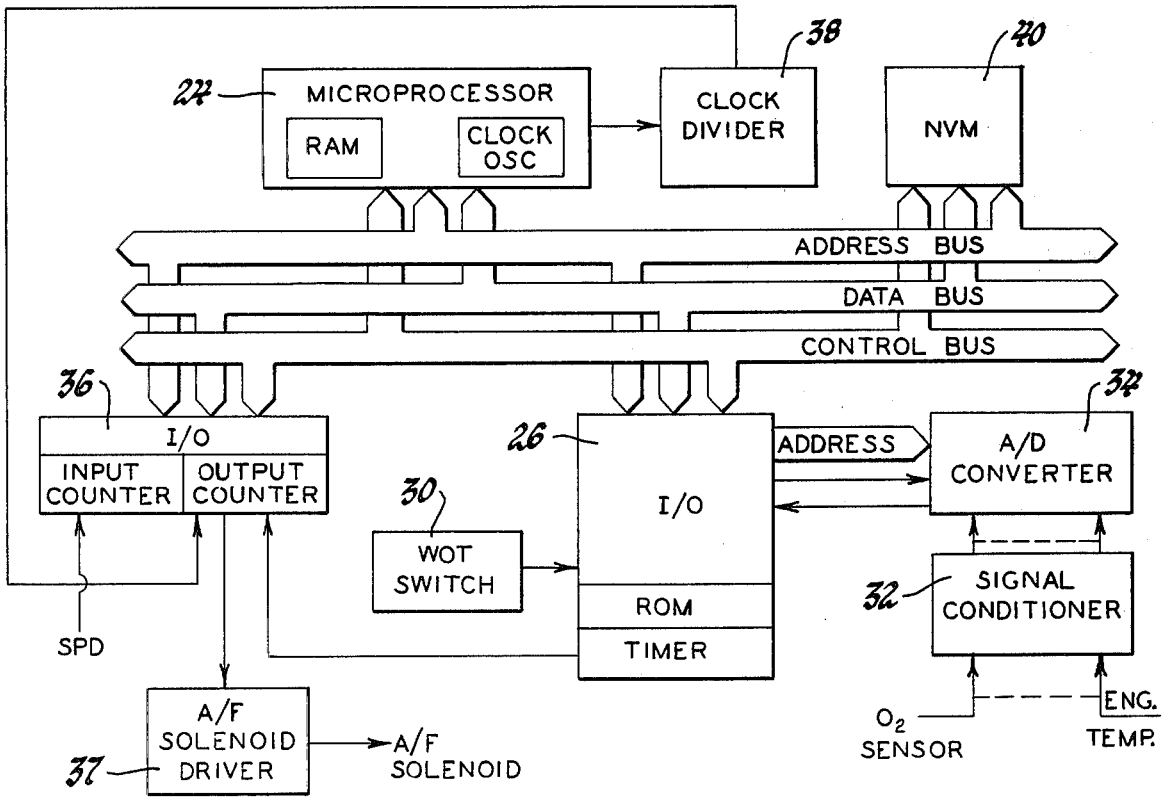
FIG. 2 illustrates a digital computer for providing a controlled adjustment of the air and fuel mixture supplied to the engine of FIG. 1 in accord with the principles of this invention.

Referring to FIG. 2, the electronic control unit 18 in the present embodiment takes the form of a digital computer that provides a pulse width modulated signal at a constant frequency to the carburetor 12 to effect adjustment of the air/fuel ratio. The digital system includes a microprocessor 24 that controls the operation of the carburetor 12 by executing an operating program stored in an external read only memory (ROM). The microprocessor 24 may take the form of a combination module which includes a random access memory (RAM) and a clock oscillator in addition to the conventional counters, registers, accumulators, flag flip flops, etc., such as a Motorola Microprocessor MC-6802. Alternatively, the microprocessor 24 may take the form of a microprocessor utilizing an external RAM and clock oscillator.

The microprocessor 24 controls the carburetor by executing an operating program stored in a ROM section of a combination module 26. The combination module 26 also includes an input/output interface and a programmable timer. The combination module 26 may take the form of a Motorola MC6846 combination module. Alternatively, the digital system may include separate input/output interface modules in addition to an external ROM and timer.

The input conditions upon which open loop and closed loop control of air/fuel ratio are based are provided to the input/output interface of the combination circuit 26. The discrete inputs such as the output of a wide open throttle switch 30 are coupled to discrete inputs of the input/output interface of the combination circuit 26. The analog signals including the air/fuel ratio signal from the sensor 20, the manifold vacuum signal VAC, the barometric pressure signal BARO and the engine temperature signal TEMP are provided to a signal conditioner 32 whose outputs are coupled to an analog to digital converter-multiplexer 34. The particular analog condition to be sampled and converted is controlled by the microprocessor 24 in accord with the operating program via the address lines from the input/output interface of the combination circuit 26. Upon command, the addressed condition is converted to digital form and supplied to the input/output interface of the combination circuit 26 and then stored in ROM designated locations in the RAM.

The duty cycle modulated output of the digital system for controlling the air/fuel solenoid in the carburetor 12 is provided by a conventional input/output interface circuit 36 which includes an output counter for providing the output pulses to the carburetor 12 via a conventional solenoid driver circuit 37. The output counter section receives a clock signal from a clock divider 38 and a 10 hz. signal from the timer section of the combination circuit 26. In general, the output counter section of the circuit 36 may include a register into which a binary number representative of the desired pulse width is periodically inserted. At a 10 hz. frequency, the number in the register is gated into a down counter which is clocked by the output of the clock divider 38 with the output pulses of the output counter section having a duration equal to the time for the down counter to be counted down to zero. In this respect, the output pulse may be provided by a flip flop set when the number in the register is gated into the down counter and reset by a carry out signal from the down counter when the number is counted to zero. The circuit 36 also includes an input counter section which receives speed pulses from an engine speed transducer or the engine distributor that gate clock pulses to a counter to provide an indication of engine speed.

While a single circuit 36 is illustrated as having an output counter section and an input counter section, each of those sections may take the form of separate independent circuits.

The system of FIG. 2 further includes a nonvolatile memory 40 having memory locations into which data can be stored and from which data may be retrieved. In this embodiment, the nonvolatile memory 40 takes the form of a RAM having power continuously applied thereto directly from the vehicle battery (not shown) and bypassing the conventional vehicle ignition switch through which the remainder of the system receives power so that the contents therein are retained in memory during the shutdown of the engine 10. Alternatively, the nonvolatile memory 40 may take the form of a memory having the capability of retaining its contents in memory without the application of power thereto.

The microprocessor 24, the combination module 26, the input/output interface circuit 36 and the nonvolatile memory 40 are interconnected by an address bus, a data bus and a control bus. The microprocessor 24 accesses the various circuits and memory locations in the ROM, the RAM and the nonvolatile memory 40 via the address bus. Information is transmitted between circuits via the data bus and the control bus includes lines such as read/write lines, reset lines, clock lines, etc.

As previously indicated, the microprocessor 24 reads data and controls the operation of the carburetor 12 by execution of its operating program as provided in the ROM section of the combination circuit 26. Under control of the program, various input signals are read and stored in ROM designated locations in the RAM in the microprocessor 24 and the operations are performed for controlling the air and fuel mixture supplied by the carburetor 12.

Figure 3:
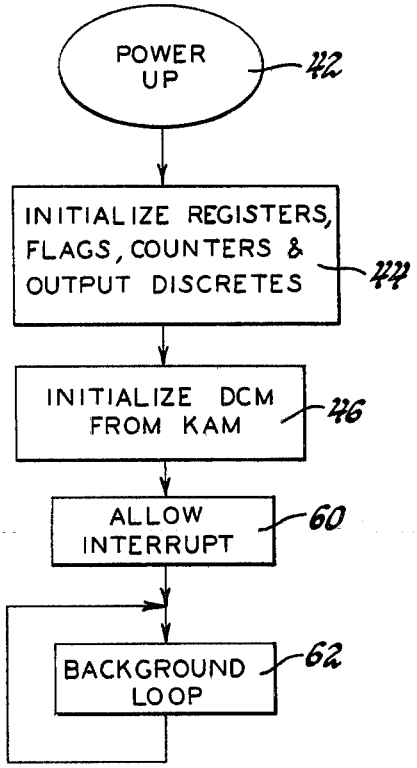
FIGS. 3 through 8 are diagrams illustrative of the operation of the digital computer of FIG. 2 for providing adjustment of the air/fuel ratio of the mixture supplied to the engine of FIG. 1 in accord with the principles of this invention.

Referring to FIG. 3, when the vehicle engine 10 is first energized by closure of its ignition switch to apply power to the various circuits, the computer program is initiated at point 42 and then proceeds to step 44. At this step, the computer provides for initialization of various elements in the computer system. For example, at this step, registers, flag flip flops, counters and output discretes are initialized.

From the step 44, the program proceeds to a step 46 where a duty cycle memory is initialized in accord with numbers stored in a keep-alive memory. The duty cycle memory is comprised of 16 memory locations $DCM_0$ thru $DCM_{15}$ in the RAM section of the microprocessor 24, each memory location being addressable in accord with an engine operating point defined by values of engine speed and load. In the present embodiment, the load factor is manifold vacuum. In other embodiments, other numbers of memory locations such as four may be provided and the engine operating point may be defined by the value of a single engine operating parameter such as load.

Figure 9:
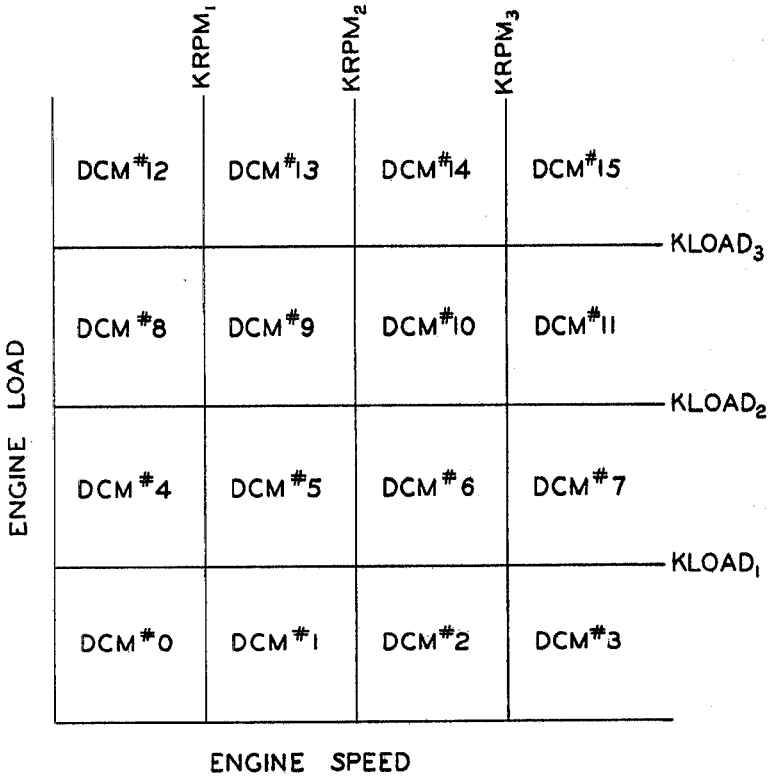
FIG. 9 is a diagram illustrative of the relationship between engine operating points and the memory locations in a duty cycle memory.
Figure 10:
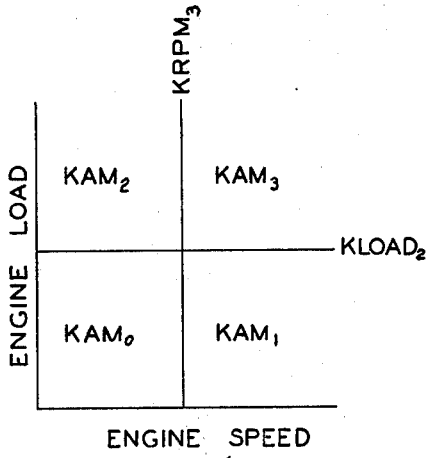
FIG. 10 is a diagram illustrative of the relationship between engine operating points and the memory locations in a duty cycle memory.
Figure 11:
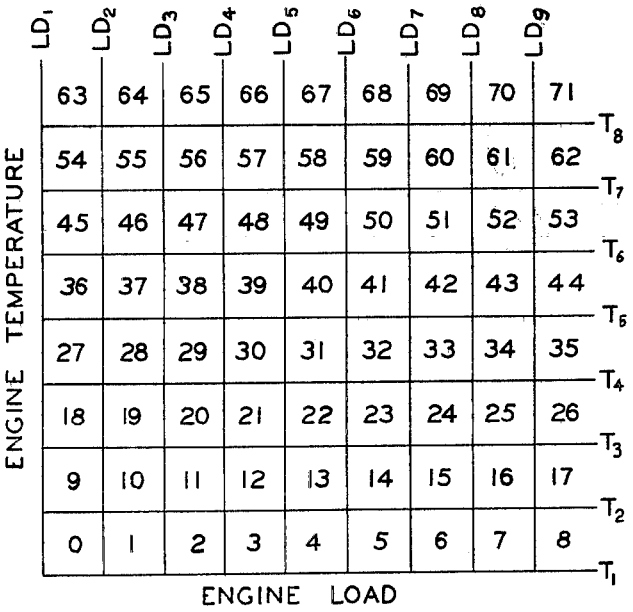
FIG. 11 is a diagram illustrating an air/fuel ratio shedule memory for open loop air/fuel ratio adjustment of the engine of FIG. 1.

The duty cycle memory location relationships to values of engine speed and load are illustrated graphically in FIG. 9. Each of the memory locations is addressable in accord with the value of engine speed relative to calibration parameters $KRPM_1$, $KRPM_2$ and $KRPM_3$ and the value of engine load relative to calibration parameters $KLOAD_1$, $KLOAD_2$ and $KLOAD_3$. For example, memory location $DCM_5$ is addressed when the engine load is between the calibration parameters $KLOAD_1$ and $KLOAD_2$ and the engine speed is between the calibration parameters $KRPM_1$ and $KRPM_2$. Each of the memory locations in the duty cycle memory is initialized when the electronic control unit 18 is first energized to carburetor adjustment values stored in the keep-alive memory which is comprised of four memory locations $KAM_0$ thru $KAM_3$ in the nonvolatile memory 40, each memory location being addressable in accord with an engine operating point in the same manner as the duty cycle memory. In this embodiment, the keep-alive memory locations are addressed in accord with the values of engine load and speed relative to the calibration parameters $KRPM_3$ and $KLOAD_2$ as illustrated in FIG. 10.

Each of the keep-alive memory locations contains a number representing the required adjustment to the carburetor 12 to supply a stoichiometric ratio at the corresponding engine operating point. This number is a pulse width producing the duty cycle for adjusting the carburetor to obtain the stoichiometric ratio. These values are determined during prior closed loop operation of the electronic control unit 18. At step 46, these values are utilized to initialize each of the duty cycle memory locations $DCM_0$ thru $DCM_{15}$ in the duty cycle memory. Each of the duty cycle memory locations addressed by engine operating points falling within an engine operating point corresponding to a keep-alive memory location is initialized to the adjustment value stored in that keep-alive memory location. For example, in this embodiment, the carburetor adjustment stored in the keep-alive memory location $KAM_0$ is placed in each of the duty cycle memory locations $DCM_0$ thru $DCM_2$ and $DCM_4$ thru $DCM_6$, the carburetor adjustment value stored in the keep-alive memory location $KAM_2$ is placed in the duty cycle memory location $DCM_8$ thru $DCM_{10}$ and $DCM_{12}$ thru $DCM_{14}$, the carburetor adjustment value stored in the keep-alive memory location $KAM_1$ is stored in each of the duty cycle memory locations $DCM_3$ and $DCM_7$ and the carburetor adjustment value stored in the keep-alive memory location $KAM_3$ is placed in each of the duty cycle memory locations $DCM_{11}$ and $DCM_{15}$. After the duty cycle memory locations have been updated in accord with the values in the keep-alive memory, the duty cycle memory contains carburetor adjustment values at each memory location previously determined during closed loop operation of the electronic control unit 18 to produce a stoichiometric ratio.

Figure 4:
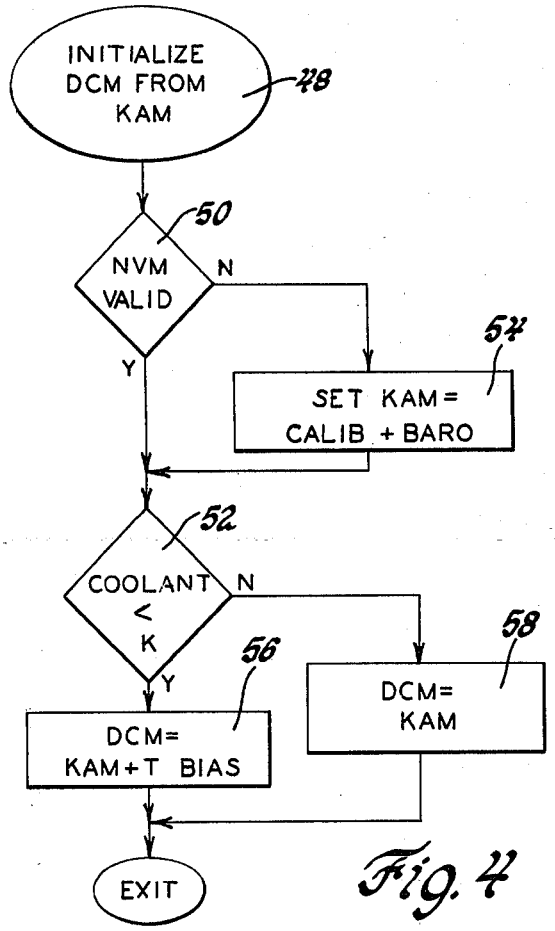

The routine for initializing the duty cycle memory from the keep-alive memory at step 46 may take the form as illustrated in FIG. 4. The routine is entered at point 48 and proceeds to a decision point 50 where the validity of the numbers stored in the nonvolatile memory is determined. For example, if the vehicle battery was disconnected or for some other reason the power was lost to the nonvolatile memory 40, the contents therein would not be valid. A known "check-sum" routine may be employed to determine the validity of the contents of the nonvolatile memory 40 or any means for detecting loss of power to the nonvolatile memory may be used. If the contents are determined to be valid, the program proceeds to a decision point 52. However, if the contents are determined not to be valid, the program proceeds to a step 54 where the keep-alive memory locations $KAM_0$ thru $KAM_3$ are initialized to calibration values stored in the ROM section of the combination module 26. These values may further be adjusted as a function of the barometric pressure. From step 54, the program then proceeds to the decision point 52.

At decision point 52, the engine coolant temperature is read and compared with a calibration constant K stored in the ROM. If the coolant temperature is less than the calibration constant, the program proceeds to a step 56 where the value stored in the duty cycle memory locations $DCM_0$ thru $DCM_{15}$ are made equal to the keep-alive memory values plus a bias determined by the coolant temperature. The temperature bias offset is provided since at temperatures below the calibration constant K, the carburetor adjustment required to produce a stoichiometric ratio is typically offset from the values previously learned during closed loop operation at which the engine temperature was substantially warmer than the value K. Returning again to step 52, if the coolant temperature is greater than the calibration constant K, the program proceeds to a step 58 where the duty cycle memory locations in the RAM are initialized to the values in the memory locations in the keep-alive memory as previously described.

From the steps 56 and 58, the program exits the routine and proceeds to a step 60 in FIG. 3 where the program is set to allow interrupt routines. This may be provided, for example, by setting an allow-interrupt flag in the microprocessor 24 which is sampled to determine whether an interrupt is permissible. After step 60, the program shifts to a background loop 62 which is continuously repeated. The background loop 48 may include control functions such as EGR control and a diagnostic and warning routine.

After the execution of the step 46, the duty cycle memory contains information relative to carburetor adjustments over the engine operating range and which forms a portion of the carburetor calibration which is used during an open loop operating mode and in open loop fashion so as to obtain a more precise control of the air/fuel ratio of the mixture supplied to the engine 10 during the engine warm-up period. Thereafter during closed loop operation as will be described, the duty cycle memory is similarly used to provide for open loop adjustments of the carburetor to obtain more precise control of the air/fuel ratio to a stoichiometric ratio.

While the system may employ numerous interrupts at various spaced intervals such as 12½ milliseconds and 25 milliseconds, it is assumed for purposes of illustrating the subject invention that a single interrupt routine is provided and which is repeated each 100 milliseconds. During each 100 millisecond interrupt routine, the electronic control unit 18 determines the carburetor control pulse width in accord with the sensed engine operating conditions and issues a pulse to the carburetor solenoid driver 37. The 100 millisecond interrupt routine is initiated by the timer section of the combination circuit 26 which issues an interrupt signal at a 10 hz. rate that interrupts the background loop routine 62.

Figure 5:
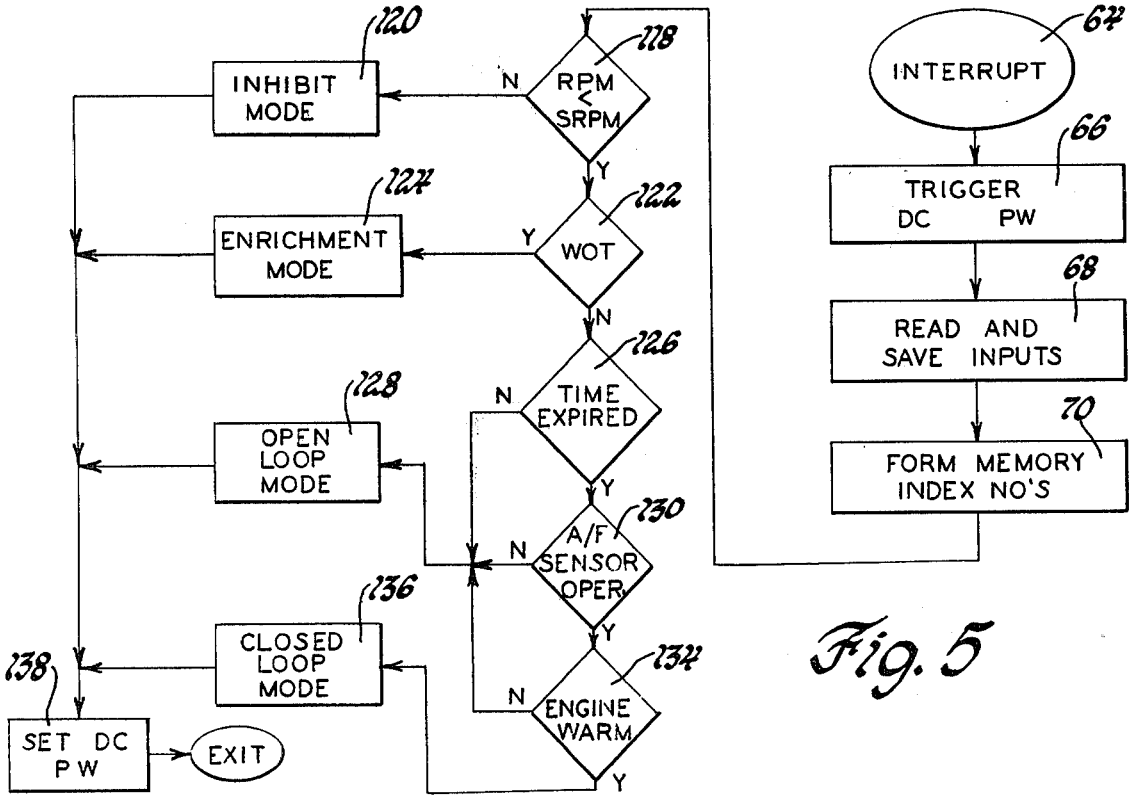

Referring to FIG. 5, at each interrupt, the program enters the 100 millisecond interrupt routine at step 64 and proceeds to step 66 where the carburetor control pulse width in the register in the output counter section of the input/output circuit 36 is shifted to the output counter to initiate a carburetor control pulse as previously described. This pulse has a duration determined in accord with the engine operation to produce the desired duty cycle signal for adjusting the carburetor 12 to obtain the desired air/fuel ratio of the mixture supplied to the engine 10. From step 66, the program proceeds to step 68 where a read routine is executed. During this routine, the discrete inputs such as from the wide-open throttle switch 30 are stored in ROM designated memory locations in the RAM, the engine speed determined via the input counter section of the circuit 36 is stored at a ROM designated memory location in the RAM and various inputs to the analog to digital converter are one by one converted by the analog to digital converter-multiplexer 34 into a binary number representative of the analog signal value and then stored in respective ROM designated memory locations in the RAM.

Figure 6:
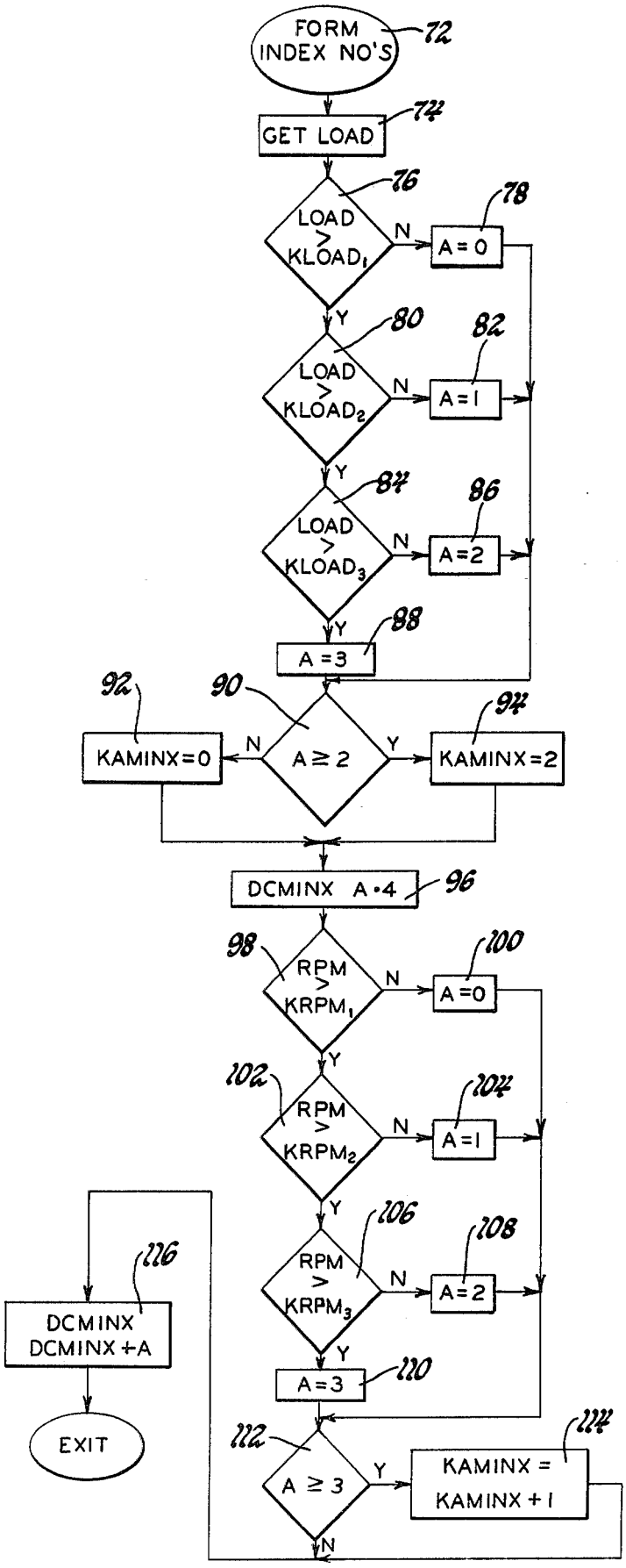

The program next proceeds to a step 70 where the memory locations in the keep-alive memory and the duty cycle memory corresponding to the existing engine operating point are determined. This routine is illustrated in FIG. 6. Referring to this figure, the form memory index number routine is entered at point 72 and then proceeds to point 74 where the value of engine load read and stored at step 68 is retrieved from the RAM. In this embodiment, engine load is represented by the value of manifold vacuum. This value is compared with a calibration constant $KLOAD_1$ at decision point 76. If the load value is less than the calibration constant $KLOAD_1$, the program proceeds to a step 78 where a stored number A in a ROM designated RAM location is set to the value zero. If at decision point 76, the load is determined to be greater than the calibration constant $KLOAD_1$, the program proceeds to the decision point 80 where the load value is compared with the second calibration constant $KLOAD_2$. If the load is less than the value $KLOAD_2$, the program proceeds to the step 82 where the stored number A is set equal to 1. If at step 80 the engine load is greater than the calibration constant $KLOAD_2$, the program proceeds to a decision point 84 where the engine load is compared with the calibration constant $KLOAD_3$. If the load value is less than the calibration constant $KLOAD_3$, the program proceeds to the step 86 where the stored number A is set equal to 2. However, if the load value is greater than the calibration constant $KLOAD_3$, the program proceeds to a step 88 where the stored number A is set to 3. From each of the steps 78, 82, 86 and 88, the program proceeds to a decision point 90 where the stored number A is compared with the number 2. If A is less than 2, the program proceeds to a step 92 where the keep-alive memory index number in a ROM designated RAM location is set equal to zero. However, if A is greater than or equal to the number 2, the program proceeds to the step 94 where the keep-alive memory index number in the RAM is set equal to 2. From each of the steps 92 and 94, the program proceeds to a step 96 where a duty cycle memory index number in a ROM designated RAM location is set equal to the product of the number A times 4.

The program next proceeds to the decision point 98 where the value of engine speed read and stored at step 68 is read from the RAM and compared with the calibration constant $KRPM_1$. If the speed is less than $KRPM_1$, the program proceeds to step 100 where the stored number A is set to zero. However, if the engine speed is greater than the calibration constant $KRPM_1$, the program proceeds to the decision point 102 where the engine speed is compared with the calibration constant $KRPM_2$. If the engine speed is less than this constant, the program proceeds to the step 104 where the stored number A is set to 1. If the engine speed is greater than the calibration constant $KRPM_2$, the program proceeds to the decision point 106 where the engine speed is compared with the calibration constant $KRPM_3$. The stored number A is set equal to 2 at step 108 if the value of engine speed is less than the calibration constant $KRPM_3$ and is set equal to 3 at step 110 if the engine speed is greater than the calibration constant $KRPM_3$. From each of the steps 100, 104, 108 and 110, the program proceeds to the decision point 112 where the number A is compared with the number 3. If A is greater than or equal to 3, the program proceeds to step 114 where the keep-alive memory index number is set equal to the keep-alive memory index number stored in the RAM at step 92 or step 94 plus 1. After step 114 or if A is determined to be less than three at decision point 112, the keep-alive memory index number stored in the RAM is the memory location in the keep-alive memory corresponding to the present engine operating condition. At step 116, the duty cycle memory index is set equal to the duty cycle memory index stored in the RAM at step 96 plus the stored number A. The duty cycle memory index then stored in the RAM is the memory location in the duty cycle memory corresponding to the existing engine operating point. The program then exits the form index numbers routine and proceeds to a decision point 118 of FIG. 5.

Beginning at the decision point 118, the computer program determines the required operating mode of the controller and controls the carburetor 12 in accord with the determined mode. At the decision point 118, the engine speed RPM stored in the RAM at the step 68 is read from the RAM and compared with a reference engine speed value SRPM stored in the ROM that is less than the engine idle speed but greater than the cranking speed during engine start. If the engine speed is not greater than the reference speed SRPM, indicating that the engine has not started, the program proceeds to an inhibit mode of operation at step 120 where the determined width of the pulse width modulated signal for controlling the carburetor 12 and which is stored at a RAM location designated by the ROM to store the carburetor control pulse width is set essentially to zero. This pulse width results in a zero percent duty cycle signal for setting the carburetor 12 to a rich setting to assist in vehicle engine starting.

If at point 118 it is determined that engine speed is greater than the reference speed SRPM indicating the engine is running, the program proceeds to a decision point 122 where it is determined whether a wide open throttle condition exists thereby requiring power enrichment. This is accomplished by sampling the information stored in the ROM designated memory location in the RAM at which the condition of the wide open throttle switch 30 was stored during step 68. If the engine is at wide open throttle, the program cycle proceeds to an enrichment mode of operation at step 124 where an enrichment routine is executed wherein the width of pulse producing the duty cycle required to control the carburetor 12 for power enrichment is determined and stored at the RAM memory location assigned to store the carburetor control pulse width.

If the engine is not operating at wide open throttle, the program proceeds from point 122 to a decision point 126 where an elapsed time counter monitoring the time since engine startup is compared with a predetermined time representing the time criteria before the closed loop operation of the electronic control unit is implemented. This timer may take the form of a counter set to zero at the initialization step 44 and which is incremented at point 126 in the program each 100 millisecond interrupt period with the number of interrupt periods representing the elapsed time. If the elapsed time is less than a predetermined value, the program executes an open loop mode routine at step 128 where an open loop pulse width and therefore duty cycle is determined and stored in the RAM location assigned to store the carburetor control pulse width. If, however, the time criteria at decision point 126 has been met, the program proceeds from point 126 to a decision point 130 where the operational condition of the air-fuel sensor 20 is determined. In this respect, the system may determine operation of the sensor 20 by parameters such as sensor temperature or sensor impedance. If the air-fuel sensor 20 is determined to be inoperative, the program again proceeds to the open loop mode routine at step 128. If the air-fuel sensor is operational, the program proceeds directly from the decision point 130 to a decision point 134 where the engine temperature stored in the RAM at step 68 is compared with a predetermined calibration value stored in the ROM. If the engine temperature is below the calibration value, the computer program proceeds to the step 128 where the open loop routine is executed as previously described. If the engine temperature is greater than the calibration value, all of the conditions exist for closed loop control of the air/fuel ratio and the program proceeds from point 134 to a step 136 where a closed loop routine is executed to determine the carburetor control signal pulse width in accord with the sensed air/fuel ratio. The determined pulse with is stored at the RAM location assigned to store the carburetor control pulse width.

From each of the program steps 120, 124, 128 and 136, the program cycle proceeds to a step 138 at which the carburetor control pulse width determined in the respective one of the operating modes is read from the RAM and entered in the form of a binary number into the register in the output counter section of the input/output circuit 36. This value is thereafter inserted into the down-counter at step 66 during the next 100 millisecond interrupt period to initiate a pulse output to the air-fuel solenoid having the desired width. The carburetor control pulse is issued to energize the air/fuel ratio control solenoid in the carburetor 12 each 100 millisecond interrupt period so that the pulse width issued at the 10 hz. frequency defines the duty cycle control signal for adjusting the carburetor 12.

Figure 7:
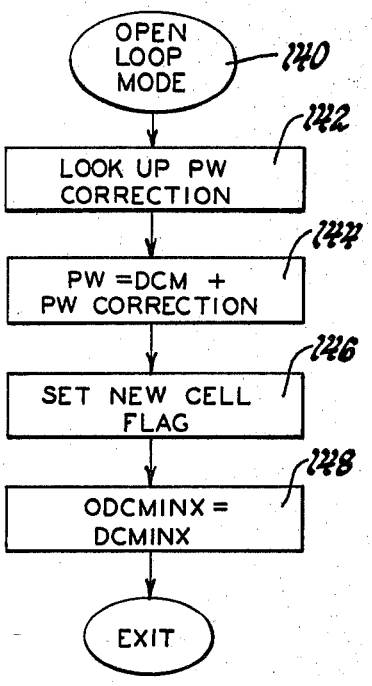

Referring to FIG. 7, the open loop mode routine at step 128 is illustrated. This routine is entered at step 140 and proceeds to step 142 where a pulse width correction value is obtained from a lookup table in the ROM section of the input/output circuit 26. While this correction factor may be a function of a single parameter such as engine temperature, the correction factor in this embodiment is a function of engine load and engine temperature. The correction factor values stored in the lookup table addressed by engine temperature and engine load represents the change in carburetor adjustment from a stoichiometric adjustment value required to produce a desired open loop air/fuel ratio at the respective load and temperature conditions. This offset from the carburetor adjustment required to produce a stoichiometric ratio is obtained by the microprocessor 24 from the ROM by addressing memory locations determined by the measured values of engine temperature and manifold vacuum. The relationship of the correction factors to engine temperature and engine load is illustrated in FIG. 7. As seen in this FIGURE, 72 memory locations are provided that are addressed in accord with the values of engine temperature and engine load with each memory location containing a pulse width correction factor producing a predetermined air/fuel ratio shaft which, when combined with the pulse width required to adjust the carburetor to supply a stoichiometric ratio, results in a desired open loop air/fuel ratio.

From the step 142, the program proceeds to step 144 where the carburetor control pulse width stored in the RAM is set equal to the value obtained from the duty cycle memory in the RAM at the address location determined from the index number formed at step 70 plus the pulse width correction obtained from the lookup table at step 142. The resulting duty cycle pulse width is effective to adjust the carburetor 12 to a predetermined air/fuel ratio at the engine operating point for the current values of engine temperature and engine load. Since the duty cycle pulse width value stored in each of the memory locations in the duty cycle memory were previously determined during prior closed loop operation to produce a stoichiometric ratio, a precise open loop air/fuel ratio is provided over the full engine operating range.

From step 144, the program proceeds to a step 146 where a new cell flag is set whose function will be described relative to the closed loop operating mode in FIG. 8. From the step 146, the program proceeds to a step 148 where the value of the duty cycle memory index (DCMINX) determined at step 70 is placed in a RAM location representing the prior or old duty cycle memory index (ODCMINX) to be used during the next 100 millisecond interrupt period, if the conditions exist for closed loop mode operation, to determine if the engine operating point has changed. Following step 148, the program exits the open loop mode routine and proceeds to step 138 (FIG. 5) where the duty cycle pulse width determined at step 144 is loaded into the register in the output counter section of the input/output circuit 36 as previously described.

Figure 8:
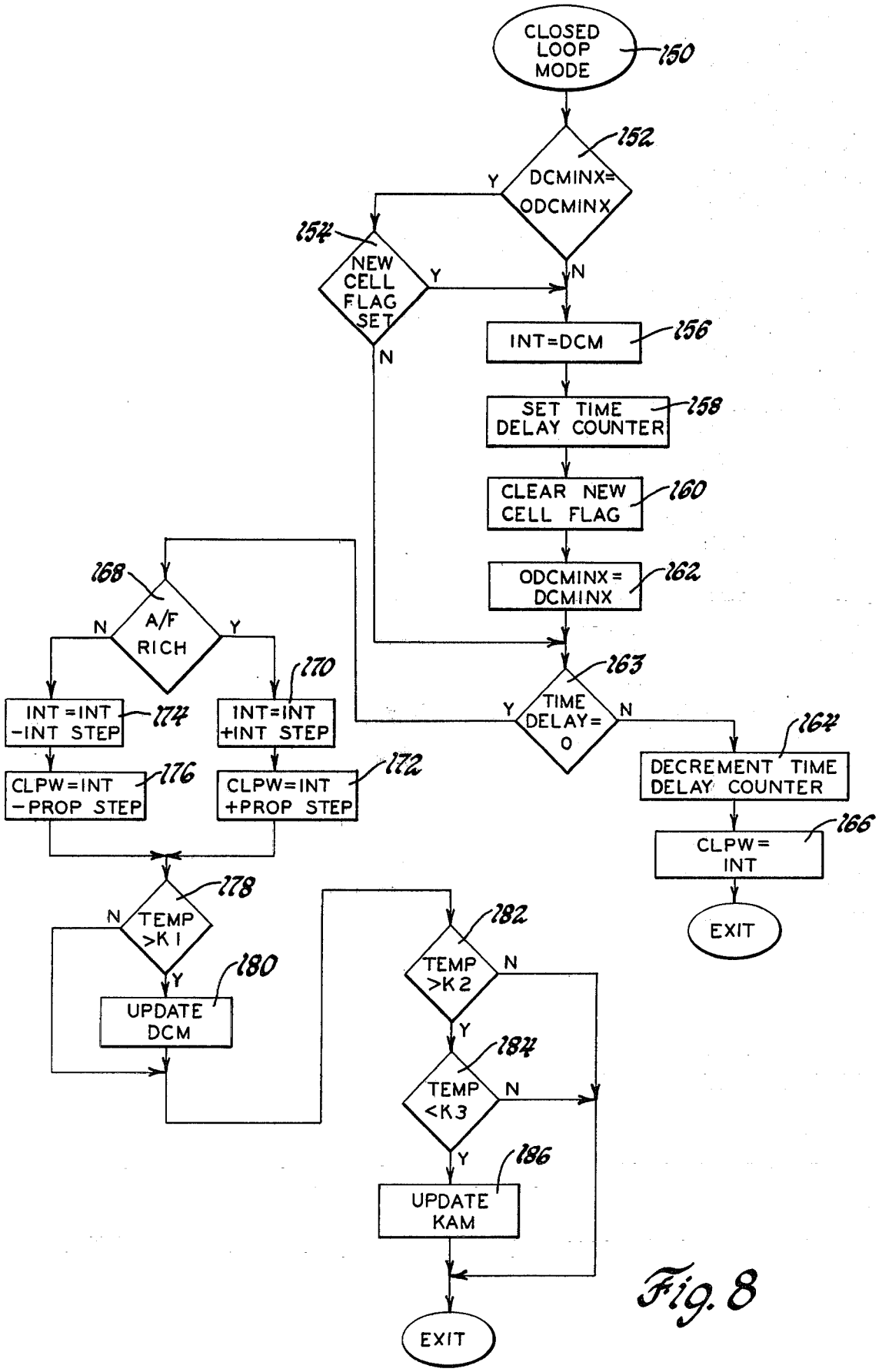

Referring to FIG. 8, the closed loop mode 136 is described. In the present embodiment, when the engine operation shifts to a new engine operating point, the carburetor control pulse width is initialized to the value stored in the duty cycle memory at the address determined by the new engine operating point. This value was determined or "learned" from prior operation to produce a stoichiometric ratio at the engine operating point. Thereafter, the carburetor control pulse width is maintained at a constant value while the engine operates at the new operating point for a time duration at least equal to the transport delay through the engine. During this delay period, the sensor 20 is not able to sense the air/fuel ratio supplied to the engine in response to the carburetor adjustment made when the engine entered the new operating point. After the expiration of the transport delay period, the carburetor control pulse width is adjusted in accord with the oxygen sensor signal and in closed loop fashion in direction tending to produce the stoichiometric ratio. Simultaneously, the duty cycle memory location and keep-alive memory location defined by the new operating point are updated in accord with the closed loop adjustment so as to effectively learn the values required to produce a stoichiometric ratio during closed loop and open loop operating modes, respectively.

The closed loop mode is entered at point 150 and proceeds to decision point 152 where it is determined whether or not the engine operating point has changed since the prior 100 millisecond interrupt. This is accomplished by retrieving the duty cycle memory index determined at step 70 from the RAM and comparing it with the old duty cycle memory index determined at step 70 in the prior 100 millisecond interrupt period. If the duty cycle memory index and the old duty cycle memory cycle index are the same, which represent that the engine operating point has not changed, the program cycle proceeds to a decision point 154 where the new cell flag flip flop in the microprocessor 24, which was set during the open loop routine at step 146, is sampled. If the flag is set, the electronic control unit 18 was operating in an open loop mode during the prior 100 millisecond interrupt period. However, if the flag is reset, the electronic control unit 18 was operating in a closed loop mode during the prior 100 millisecond interrupt period.

Assuming that the engine has either changed operating points since the prior 100 millsecond interrupt period or the electronic control unit 18 has changed operation from open loop mode to closed loop mode, the program proceeds from either the point 152 or 154 to a step 156 where the integral control term portion of the closed loop control signal stored at a ROM designated RAM location is set equal to the pulse width obtained from the duty cycle memory at the memory location addressed by the engine operating point determined at step 70. This pulse width value was learned during prior closed loop operation as the value for adjusting the carburetor 12 to supply a stoichiometric ratio. From step 156, the program proceeds to a step 158 where a transport time delay counter is set to a value representing the transport delay through the engine 10. This transport delay may be determined from engine operating parameters including engine speed and manifold vacuum and may be obtained from a lookup table in the ROM section of the combination module 26 addressed by those engine operating parameters. The number stored in the respective locations representing transport delay is the number of 100 millisecond periods equalling the transport delay.

At step 160, the new cell flag flip flop in the microprocessor 24 is cleared to represent that the electronic control unit 18 has been operating in the closed loop mode. Thereafter, the program proceeds to step 162 where the old duty cycle memory index stored in the RAM is set equal to the duty cycle memory index determined at step 70.

From the step 162 or the decision point 154, the program proceeds to a decision point 163 where the transport delay counter is sampled to determine whether the transport delay has expired. If the transport delay has not expired, the program proceeds to a step 164 where the transport time delay counter is decremented. Thereafter at step 166, the carburetor control pulse with stored in the RAM is set equal to the integral control term of the closed loop pulse width that was previously set at step 156 to the duty cycle memory value and which represents the value producing a stoichiometric ratio at the engine operating point and which was learned during prior operation at the respective engine operating point. Thereafter, the program exits the closed loop mode routine and proceeds to the step 138 in FIG. 5 where the duty cycle pulse width is set into the register in the output counter section of the input-/output circuit 36.

If at step 156 it is determined that the transport delay counter has decremented to zero representing that a transport delay period has lapsed since the engine last changed operating points or since the engine shifted from an open loop operating mode to a closed loop operating mode, the program proceeds to adjust the carburetor control pulse width in response to the exhaust gas sensor in direction tending to obtain a stoichiometric ratio. This is accomplished by the program first proceeding to a step 168 where the output of the sensor 20 is compared with a calibration constant to determine whether the air/fuel ratio of the mixture sensed is rich or lean relative to the stoichiometric ratio. If the air/fuel ratio is rich, the program proceeds to a step 170 where the integral term of the closed loop control signal stored in the RAM is set equal to the integral term previously stored thereat plus an integral step value. Thereafter, at step 172, the closed loop control pulse width is set equal to the integral term determined at step 170 plus a proportional step value. However, if at step 168 it is determined that the air/fuel ratio is lean, the program proceeds to a step 174 where the integral term of the closed loop control signal stored in the RAM is decreased by an integral step value. Thereafter at step 176, the closed loop pulse width is set equal to the integral term stored in the RAM minus a proportional step value. The steps 168 thru 176 are repeated each 100 milliseconds after the engine is operated at the same operating point for a period greater than the transport delay period thereby forming a closed loop pulse width value increasing or decreasing in ramp fashion depending upon whether the air/fuel ratio is rich or lean at a rate determined by the integral step and until the air/fuel ratio changes between rich and lean states. At this time a proportional step in the pulse width in the direction producing a stoichiometric ratio is provided. The resulting duty cycle of the signal provided to the carburetor is in the form of a ramp plus step function having an average duty cycle value equal to the value required to adjust the carburetor 12 to obtain a stoichiometric ratio.

From each of the steps 172 and 176, the program proceeds to adjust the values in the duty cycle memory in accord with this invention and to adjust the values in the keep alive memory to values representing adjustments required to obtain a stoichiometric ratio at the respective engine operating points for open and closed loop operation. From the steps 172 and 176, the program proceeds to a decision point 178 where the temperature of the engine read at step 68 is compared with a calibration constant $K_1$. This constant represents an excessively high engine temperature above which it is desired not to provide for updating of the pulse widths stored in the duty cycle memory. If the temperature is below the calibration constant $K_1$, the program proceeds to step 180 where the duty cycle memory is updated at the memory location determined by the engine operating point (the duty cycle memory index determined at step 70) and which has remained constant for a period at least greater than the engine transport delay. Since the duty cycle memory is utilized during the closed loop operation of the electronic control unit 18 to provide for an instantaneous adjustment of the carburetor control pulse width when the engine operating points change, it is desirable to update the duty cycle memory in direction to obtain correspondence between the duty cycle memory value and the average value of the carburetor control pulse width at a rate so that the values stored in the duty cycle memory are representative of the values required to adjust the carburetor to obtain a stoichiometric ratio even while values of engine operating parameters such as engine temperature are varying. For example, if the engine experiences a temperature variation, it is desired that the values placed in the duty cycle memory track the values required to produce a stoichiometric ratio for the changing temperature conditions. Since the engine temperature increases at a faster rate during the engine warm-up period, in accord with this invention, the update time constant is made small at cold engine temperatures and is increased as the engine temperature increases to normal operating levels.

Figure 12:
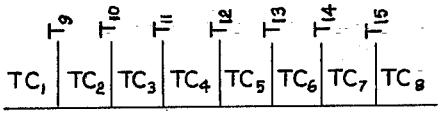
FIG. 12 is a diagram illustrative of the relationship between engine temperature and memory locations storing duty cycle memory update time constant values.

The duty cycle memory at the memory location addressed by the engine operating point is updated in accord with the expression $DCMV_N = DCMV_{N-1} + (DC - DCM_{N-1})/TC_X$ where $DCMV_N$ is the new pulse width value to be inserted into the memory location addressed by the engine operating point, $DCMV_{N-1}$ is the pulse width value previously at that duty cycle memory location, DC is the last determined carburetor control pulse width and $TC_X$ is a filter time constant. This equation is the discrete form of a first order lag filter. The value of the time constant determining value $TC_X$ is varied in accord with the engine temperature and employs an additional lookup table in the ROM. The ROM address locations and their relationship to engine temperature are illustrated in FIG. 12. In the present embodiment, eight time delay values are stored in memory locations $TC_1$ through $TC_8$ in the ROM and are addressed in accord with the value of engine temperature relative to the calibration temperature values $T_9$ through $T_{15}$ stored in the ROM. Assuming $T_9$ being the lowest temperature value, with the temperature values $T_{10}$ through $T_{15}$ increasing to the highest value $T_{15}$, the time constant values stored in the ROM memory locations $TC_1$ through $TC_8$ increase from a low value in location $TC_1$ to a high value in location $TC_8$. This results in the foregoing expression for $DCMV_N$ having a fast time constant at low values of engine temperature where engine temperature experiences its greatest rate of change to a slow time constant at the high values of engine temperature where engine temperature is relatively steady. In this manner, the duty cycle memory locations are updated toward the value of the closed loop carburetor control pulse width at a rate so that the stored value substantially equals the value required to produce a stoichiometric ratio even during engine warmup when the engine temperature increases rapidly. In one embodiment, the time constant of the aforementioned expression for updating the duty cycle memory may vary from 5 seconds to 30 seconds as a function of engine temperature increasing from a value less than $T_9$ to a value greater than $T_{15}$, the 5 second time constant during cold engine operation providing for rapid update of the duty cycle memory during periods when the engine temperature variation is most rapid. The program steps stored in the ROM to implement the foregoing expression employ standard techniques and are therefore not illustrated.

Following the step 180, the program determines whether the conditions exist for updating the keep alive memory values. Since the pulse width values stored in the keep alive memory are used during a subsequent open loop mode operation as values representing the adjustment to the carburetor required to produce a stoichiometric ratio, the keep alive memory is updated only when the engine temperature values are not excessively cold or hot representing abnormal engine operation and with an update time constant such that the numbers stored in the keep alive memory locations are the average of values producing a stoichiometric ratio during varying values of engine operating parameters so that the keep alive memory values do not represent momentary transient conditions. This is opposed to the more rapid updating of the duty cycle memory values during closed loop operation when benefits from a more rapid update where transient conditions are followed. At step 182, the engine temperature is compared with a calibration constant $K_2$ representing a temperature below which the keep alive memory is not updated. If the temperature is less than this calibration temperature, the program exits the closed loop mode routine. However, if the temperature is greater than the calibration value $K_2$, the program proceeds to a decision point 184 where the temperature is compared with a calibration contant $K_3$ representing a temperature above which the keep alive memory is not updated. If the temperature is greater than $K_3$, the program exits the closed loop mode routine. If the engine temperature is between $K_2$ and $K_3$ representing normal engine operation, the conditions exist for updating the keep alive memory location addressed by the engine operating point and represented by the keep alive memory index calculated at step 70 of FIG. 5.

The keep alive memory location addressed by the engine operating point is updated at step 186 in accord with the expression $KAMV_N = KAMV_{N-1} + (DC - KAMV_{N-1})/TC_Y$ is the new pulse width value to be stored in the keep alive memory at the location addressed by the engine operating point, $KAMV_{N-1}$ is the value previously at the memory location, DC is the carburetor control pulse width and $TC_Y$ is a filter time constant. The equation is the discrete form of a first quarter lag filter. The value of $TC_Y$ is substantially larger than the largest value of $TC_X$ thereby providing a time constant in the updating of the keep alive memory that is an average of the closed loop carburetor control pulse width required to obtain a stoichiometric ratio for varying values of the engine operating parameters including temperature. For example, during an engine temperature transient, the duty cycle memory locations are updated substantially rapidly to the value of the carburetor control pulse width required to produce a stoichiometric ratio for the existing values of engine temperature while the keep alive memory location is updated substantially slower to obtain an average value of the carburetor control pulse widths required to produce a stoichiometric ratio for varying the values of engine temperature. The value of $TC_Y$ may be such as to provide a time constant in the foregoing expression of 240 seconds.

Following the step 186, the program exits the closed loop mode routine. As the engine continues to operate in closed loop fashion, the aforementioned sequence beginning at step 150 is continually repeated so that as the engine operates over the various operating points, each of the memory locations in the duty cycle memory and keep alive memory are updated in accord with foregoing expressions in response to the value of the carburetor control signal so that each of the memory locations are updated to the value required to produce a stoichiometric ratio for the particular engine operating point. During closed loop operation, each time the engine operating point changes, the carburetor control pulse width is instantaneously preset to the value producing a stoichiometric ratio at the existing values of the engine operating parameters. During open loop operation, the carburetor is adjusted in accord with at least the values retained in memory in the keep alive memory and which represents the average of the carburetor control pulse widths required to produce a stoichiometric ratio for varying values of engine parameters.

The foregoing description of a preferred embodiment for the purposes of illustrating the invention are not to be considered as limiting or restricting the invention since many modifications may be made by the exercise of skill in the art without departing from the scope of the invention.

The embodiments of the invention in which an exclusive property or privilege is claimed are defined as follows:

1. An adaptive closed loop air/fuel ratio controller for an internal combustion engine having supply means to supply a mixture of fuel and air to the engine and a sensor providing a sensor signal in response to the air/fuel ratio of the mixture supplied to the engine, the means to supply a mixture of air and fuel being characterized by the variations in the air/fuel ratio of the mixture supplied thereby in response to varying engine temperature, the controller including, in combination:

means effective to sense engine temperature;

a memory having numbers stored at locations addressable in accordance with an engine operating point determined by at least the value of engine load; and means effective (a) to adjust the supply means in accord with the number stored in the memory at the location addressed by the engine operating point at least when the engine first operates at said operating point and, at least at some times, in accord with the sensor signal in a direction to establish a predetermined air/fuel ratio and (b) to adjust the number in the memory at the address corresponding to the engine operating point in a direction to cause correspondence with the value of the supply means adjustment and at a rate in accord with a predetermined time constant, the predetermined time constant having a value varying directly with the value of the sensed engine temperature, whereby the numbers in the memory are each updated substantially to the value producing the predetermined closed loop air/fuel ratio at the respective engine operating point during varying values of engine temperature and whereby the rate of adjustment of the numbers in the memory is greater during engine warmup where engine temperature increases rapidly.

2. An adaptive closed loop air/fuel ratio controller for an internal combustion engine having supply means to supply a mixture of fuel and air to the engine and a sensor providing a sensor signal in response to the air/fuel ratio of the mixture supplied to the engine, the means to supply a mixture of air and fuel being characterized by the variations in the air/fuel ratio of the mixture supplied thereby in response to varying engine temperature, the controller including, in combination:

means effective to sense engine temperature;

a memory having numbers stored at locations addressable in accordance with an engine operating point determined by at least the value of engine load;

means effective to recurrently (a) adjust the supply means in accord with the number stored in the memory at the location addressed by the engine operating point at least when the engine first operates at said operating point and, at least at some times, in accord with the sensor signal in a direction to establish a predetermined air/fuel ratio and (b) adjust the number in the memory at the address corresponding to the engine operating point in a direction to cause correspondence with the value of the supply means adjustment and by an amount determined by a time constant having a value varying directly with the value of the sensed engine temperature, whereby the numbers in the memory are each updated substantially to the value producing the predetermined closed loop air/fuel ratio at the respective engine operating point during varying values of engine temperature and whereby the rate of adjustment of the numbers in the memory is greater during engine warmup where engine temperature increases rapidly.

3. The method of controlling the air/fuel ratio in an internal combustion engine having supply means to supply a mixture of fuel and air to the engine and a sensor providing a sensor signal in response to the air/fuel ratio of the mixture supplied to the engine, the method including the steps of:

determining the engine operating point;

adjusting the supply means in accord with a number stored in a memory at a location addressed by the engine operating point at least when the engine first operates at said operating point and, at least at some times, in accord with the sensor signal in a direction to establish a predetermined closed loop air/fuel ratio; and adjusting the number in the memory at a location addressed by the engine operating point in a direction to cause correspondence with the value of the supply means adjustment and at a rate directly proportional to the value of engine temperature so that the numbers in the memory are each updated substantially to the value producing the predetermined closed loop air/fuel ratio at the respective engine operating point during varying values of engine temperature and at a rate that is greater during colder engine temperatures where the rate of change of temperature is greater.

* * * * *

UNITED STATES PATENT AND TRADEMARK OFFICE

CERTIFICATE OF CORRECTION

PATENT NO. : 4,306,529

DATED : December 22, 1981

INVENTOR(S) : Alan F. Chiesa et al

It is certified that error appears in the above—identified patent and that said Letters Patent is hereby corrected as shown below:

Column 1, line 25, "pulse" should read -- plus --.

Column 2, line 16, delete the semicolon after "air/fuel"; line 59, "duty cycle" should read -- keep-alive --; line 61, "shedule" should read -- schedule --.

Column 3, line 32, "wise" should read -- wide --.

Column 4, line 36, the numeral -- 12 -- should be inserted after "carburetor".

Column 5, line 35, -- mode -- should be inserted after "shutdown".

Column 10, line 45, "with" should read -- width --.

Column 11, line 20, "shaft" should read -- shift --.

Column 13, line 2, "with" should read -- width --.

UNITED STATES PATENT AND TRADEMARK OFFICE

CERTIFICATE OF CORRECTION

PATENT NO. : 4,306,529

DATED : December 22, 1981

INVENTOR(S) : Alan F. Chiesa et al

It is certified that error appears in the above—identified patent and that said Letters Patent is hereby corrected as shown below:

Column 15, line 23, "when" should read -- which --; line 45, after "/$TC_Y$" insert -- where $KAMV_N$ --; line 50, "The" should read -- This --.

Signed and Sealed this

Fourth Day of May 1982

[SEAL]

Attest:

GERALD J. MOSSINGHOFF

Attesting Officer

Commissioner of Patents and Trademarks